US008538036B2

(12) United States Patent
Pompei

(10) Patent No.: US 8,538,036 B2
(45) Date of Patent: Sep. 17, 2013

(54) DIRECTED ACOUSTIC SOUND SYSTEM

(76) Inventor: Frank Joseph Pompei, Wayland, MA (US)

( * ) Notice: Subject to any disclaimer, the term of this patent is extended or adjusted under 35 U.S.C. 154(b) by 202 days.

(21) Appl. No.: 12/916,960

(22) Filed: Nov. 1, 2010

(65) Prior Publication Data

US 2011/0044467 A1 Feb. 24, 2011

Related U.S. Application Data

(63) Continuation of application No. 10/697,208, filed on Oct. 30, 2003, now abandoned.

(60) Provisional application No. 60/422,582, filed on Oct. 30, 2002.

(51) Int. Cl.
*H04R 27/00* (2006.01)

(52) U.S. Cl.
USPC ..... 381/85; 381/77; 381/81; 381/82

(58) Field of Classification Search
USPC ..... 381/77, 79, 111–113, 81, 82, 85
See application file for complete search history.

(56) References Cited

U.S. PATENT DOCUMENTS

| | | | |
|---|---|---|---|
| 3,398,810 | A | 8/1968 | Clark, III |
| 4,081,626 | A | 3/1978 | Muggli et al. |
| 4,246,449 | A | 1/1981 | Biber |
| 4,308,422 | A | 12/1981 | Schmoll, III |
| 4,404,489 | A | 9/1983 | Larson, III et al. |
| 4,588,917 | A | 5/1986 | Ratcliff |
| 4,603,408 | A | 7/1986 | Singhal et al. |
| 4,695,986 | A | 9/1987 | Hossack |
| 4,823,908 | A | 4/1989 | Tanaka et al. |
| 4,887,248 | A | 12/1989 | Griebeler |
| 4,963,782 | A | 10/1990 | Bui et al. |
| 5,161,128 | A | 11/1992 | Kenney |
| 5,287,331 | A | 2/1994 | Schindel et al. |
| 5,436,976 | A | 7/1995 | Dougherty |
| 5,600,610 | A | 2/1997 | Hill et al. |

(Continued)

FOREIGN PATENT DOCUMENTS

| | | | |
|---|---|---|---|
| GB | 2151025 | A | 7/1985 |
| WO | WO/0011911 | | 3/2000 |
| WO | WO/0108449 | A1 | 2/2001 |
| WO | WO01/15491 | A1 | 3/2001 |

OTHER PUBLICATIONS

Acustica, vol. 4, 1954, No. 5, *Condenser Transmitters and Michrophones With Solid Dielectric for Airborne Ultrasonics*, W. Kuhli, G.R. Schodder and F-K Schroder, III. Physikaliseches Institute der Universitat Gottingen, pp. 519-532.

*Primary Examiner* — Disler Paul
(74) *Attorney, Agent, or Firm* — Chapin IP Law, LLC

(57) ABSTRACT

An acoustic sound system usable in electronic entertainment systems that generates highly directional sound. The directed acoustic sound system includes a parametric audio sound system having a modulator for modulating an ultrasonic carrier signal with a processed audio signal, a driver amplifier for amplifying the modulated signal, and a parametric loudspeaker for projecting the modulated and amplified signal through the air for subsequent regeneration of the audio signal along a pre-selected path. The acoustic sound system allows a user to select the parametric loudspeaker, a connectable non-directional loudspeaker, or both loudspeakers for producing audible sound. The acoustic sound system may be employed in the home, in the workplace, or in any other environment where audio leakage is undesirable.

24 Claims, 5 Drawing Sheets

(56) References Cited

U.S. PATENT DOCUMENTS

| | | | | |
|---|---|---|---|---|
| 5,619,476 | A | 4/1997 | Haller et al. | |
| 5,859,915 | A | 1/1999 | Norris | |
| 5,870,351 | A | 2/1999 | Ladabaum et al. | |
| 5,982,709 | A | 11/1999 | Ladabaum et al. | |
| 6,016,351 | A | 1/2000 | Raida et al. | |
| 6,044,160 | A | 3/2000 | Norris | |
| 6,229,899 | B1 | 5/2001 | Norris et al. | |
| 6,445,804 | B1 | 9/2002 | Hirayanagi | |
| 6,754,452 | B2 | 6/2004 | Kurtz | |
| 6,807,281 | B1 | 10/2004 | Sasaki et al. | |
| 7,181,023 | B1 | 2/2007 | Andrews et al. | |
| 7,298,853 | B2 * | 11/2007 | Norris et al. | 381/77 |
| 7,577,260 | B1 * | 8/2009 | Hooley et al. | 381/77 |
| 2001/0007591 | A1 | 7/2001 | Pompei | |
| 2002/0048373 | A1 | 4/2002 | Paritsky et al. | |
| 2003/0005461 | A1 | 1/2003 | Shinohara | |
| 2003/0026436 | A1 * | 2/2003 | Raptopoulos et al. | 381/71.4 |
| 2003/0063755 | A1 | 4/2003 | Nourse et al. | |
| 2003/0185404 | A1 | 10/2003 | Milsap | |

* cited by examiner

DIRECTED ACOUSTIC SOUND SYSTEM

CROSS REFERENCE TO RELATED APPLICATIONS

This application is a continuation application of U.S. patent application Ser. No. 10/697,208 filed Oct. 30, 2003 entitled DIRECTED ACOUSTIC SOUND SYSTEM.

This application claims benefit of the priority of U.S. Provisional Patent Application No. 60/422,582 filed Oct. 30, 2002 entitled DIRECTED ACOUSTIC SOUND SYSTEM.

STATEMENT REGARDING FEDERALLY SPONSORED RESEARCH OR DEVELOPMENT

Not applicable

BACKGROUND OF THE INVENTION

The present invention relates generally to sound systems usable in electronic entertainment systems such as televisions, radios, compact disk players, and video games, and more specifically to acoustic sound systems capable of producing highly directional sound.

In recent years, there has been a dramatic increase in the variety of electronic entertainment systems available in the marketplace. In the not-too-distant past, choices of electronic entertainment were limited primarily to radio, television, the phonograph, and the tape recorder. Today, electronic entertainment choices have expanded beyond traditional radio, television, and tape/disk recording media to include video games, compact disk players, digital video disk players, Internet radio, and MP3 systems. As a result of this dramatic increase in consumer choice, electronic entertainment systems have become ubiquitous both inside and outside the home environment.

For example, whereas families of the mid-twentieth century may have gathered around the same radio or television in their homes to enjoy favorite radio or television programs, each member of the twenty-first century household may be simultaneously engaged in a different form of electronic entertainment. Not only may such individuals enjoy chosen forms of electronic entertainment in their homes, but they may also enjoy diverse forms of electronic entertainment while walking outdoors, driving in their cars, riding on trains and airplanes, and working at their jobs, due to the reduced size and portability of today's electronic entertainment systems.

One drawback of the electronic entertainment systems available today is that the sound they generate is generally non-directional, i.e., the sound radiates essentially in all directions. Because the sound generated by such electronic entertainment systems radiates essentially omnidirectionally, virtually all people in the proximity of the system are forced to listen to the sound, including those who have no need or desire to hear it. This can lead to undue distraction at home and in the car, increased noise pollution in neighborhoods and on public transportation, and decreased efficiency in the workplace.

It would therefore be desirable to have a sound system for electronic entertainment systems and any other suitable sound-generating systems and devices that avoids the drawbacks of the above-described conventional sound systems.

BRIEF SUMMARY OF THE INVENTION

In accordance with the present invention, an acoustic sound system usable in electronic entertainment systems is provided that generates highly directional sound. Benefits of the presently disclosed directed acoustic sound system are achieved by employing a parametric loudspeaker that generates beams of audible sound with much higher directivity than conventional audio sound sources.

In one embodiment, the directed acoustic sound system comprises a parametric audio sound system including a modulator for modulating an ultrasonic carrier signal with a processed audio signal, a driver amplifier for amplifying the modulated carrier signal, and a parametric loudspeaker for projecting the modulated and amplified carrier signal through a propagation medium, e.g., the air, for subsequent regeneration of the audio signal along a pre-selected projection path. In a preferred embodiment, the parametric loudspeaker is a parametric array that generates sound beams using at least one membrane-type acoustic transducer. The driver amplifier may include an inductor coupled to the capacitive load of the transducer to form a resonant circuit. The center frequency of the membrane-type transducer, the resonance frequency of the resonant circuit formed by the driver amplifier coupled to the transducer, and the frequency of the ultrasonic carrier signal are equal to the same predetermined value, preferably, at least 45 kHz.

In the presently disclosed embodiment, the parametric loudspeaker operates by employing the nonlinear interaction between high frequency sound components (preferably in the ultrasonic frequency range) and the propagation medium to generate at least one beam of lower frequency sounds within the propagation medium. The result is a "virtual" sound source that is significantly larger than the wavelengths of the sounds generated by it. The larger the source of the sound, particularly in the axial direction (i.e., in the direction of propagation of the sound beam), the greater its directivity.

Accordingly, if a virtual sound source comprising a relatively long beam of ultrasound is generated using multiple frequencies, then the nonlinear interaction between the ultrasound and the propagation medium may be used to generate a narrow beam of audible sound. The directivity of the sound generated by the parametric loudspeaker can be controlled by creating a virtual sound source comprising one or more beams of ultrasound in any suitable geometric configuration, e.g., a disk, a cylinder, or a plane.

The presently disclosed directed acoustic sound system may be employed in the home, in the workplace, or in any other environment where audio leakage is undesirable. For example, the directed acoustic sound system may be used in conjunction with a television set to allow an individual to watch and to listen to the television while preventing others in the same room from hearing the sound. The directed acoustic sound system may also be used with a radio, a compact disc player, or an MP3 player to allow an individual to listen to audio selections without bothering others nearby. In addition, the directed acoustic sound system may be used with a speakerphone in an office environment to avoid distracting coworkers while enhancing the privacy of the person using the phone.

By providing electronic entertainment systems and any other suitable sound-generating systems and devices with directed acoustic sound as described above, individuals can listen to such systems without unduly distracting others in the general vicinity of the system.

Other features, functions, and aspects of the invention will be evident from the Detailed Description of the Invention that follows.

BRIEF DESCRIPTION OF THE SEVERAL VIEWS OF THE DRAWINGS

The invention will be more fully understood with reference to the following Detailed Description of the Invention in conjunction with the drawings of which.

DETAILED DESCRIPTION OF THE INVENTION

U.S. patent application Ser. No. 10/697,208 filed Oct. 30, 2003 entitled DIRECTED ACOUSTIC SOUND SYSTEM is incorporated herein by reference in its entirety.

U.S. Provisional Patent Application No. 60/422,582 filed Oct. 30, 2002 entitled DIRECTED ACOUSTIC SOUND SYSTEM is incorporated herein by reference in its entirety.

A directed acoustic sound system usable in electronic entertainment systems is disclosed that is capable of generating highly directional sound. The presently disclosed directed acoustic sound system includes a parametric loudspeaker configured to generate audible sound beams with a directivity that is significantly greater than can be achieved using conventional techniques.

Figure 1:
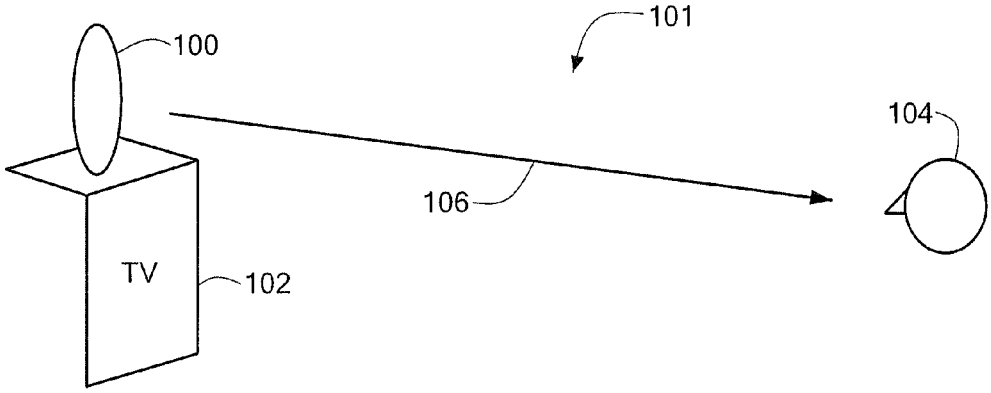
FIG. 1 depicts an illustrative application of the directed acoustic sound system according to the present invention.
Figure 2:
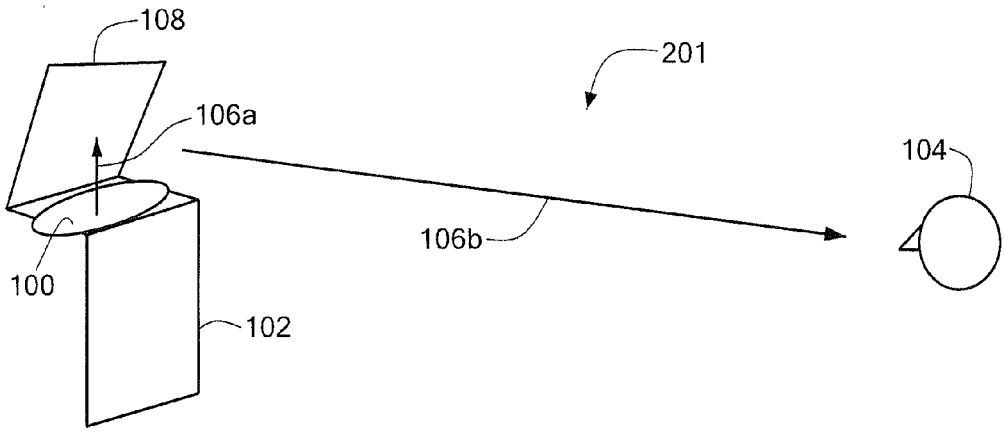
FIG. 2 depicts a variation of the illustrative application of the directed acoustic sound system of FIG. 1.

FIGS. 1-2 depict illustrative applications 101 and 201 of a directed acoustic sound system 100, in accordance with the present invention. As shown in FIGS. 1-2, the acoustic sound system 100 is employed in conjunction with a television set 102 for directing at least one audio sound beam 106 provided by the television to a human television viewer 104. It should be appreciated that the acoustic sound system 100 may alternatively be employed with a conventional broadcast radio, a conventional reel-to-reel or cassette tape recorder, a conventional phonograph, a Compact Disk (CD) player, a Digital Video Disk (DVD) player, a laser disk player, a video game, a desktop computer, a laptop computer, an Internet radio, an MP3 system, a speakerphone, or any other suitable electronic system or device capable of generating audible sound. FIGS. 1-2 depict the acoustic sound system 100 in conjunction with the television 102 for purposes of illustration.

As shown in FIG. 1, the directed acoustic sound system 100 includes a parametric array configured as a circular disk. The parametric array includes at least one acoustic transducer. It is noted that the parametric array may alternatively be configured as a cylinder, a plane (e.g., a rectangle), or any other suitable geometric shape. The acoustic sound system 100 is coupled to at least one audio output channel (not shown) of the television 102. Further, the acoustic sound system 100 is mounted on top of the television 102 so that the audio sound beam 106 generated by the system is directed toward the television viewer 104. Because the audio sound beam 106 generated by the acoustic sound system 100 is highly directional, the television viewer 104 can watch and listen to the television 102 without unduly distracting others nearby.

It is noted that the disk comprising the parametric array may alternatively be mounted near the television viewer 104 (e.g., on a stand located either above or to one side of the viewer 104), or directly mounted on the ceiling or a wall, so long as the audio sound beams 106 generated by the acoustic sound system 100 are substantially directed toward the viewer 104. In each case, the sound generated by the acoustic sound system 100 will only be substantially heard by listeners in the direct path of the sound beam.

For example, the parametric array and/or the reflector surface(s) may be mounted using cable hangers, picture hooks, ball mounts, or any other suitable hanging apparatus. In the preferred embodiment, ball joints are employed to allow the position of the parametric loudspeaker to be easily controlled.

As shown in FIG. 2, the directed acoustic sound system 100 is mounted on top of the television 102 so that the audio sound beam 106*a* generated by the system is directed upward toward a solid surface 108. Because solid surfaces generally reflect sound easily, the audio sound beam 106*a* is redirected by the surface 108 to direct a reflected audio sound beam 106*b* toward the television viewer 104. For example, the solid surface 108 may comprise a clear piece of plastic, and the disk may be permanently mounted within the housing of the television 102. Such a configuration not only provides a more aesthetically pleasing appearance, but it also allows a more thorough integration of the television electronics to facilitate fabrication of the system.

It is understood that the solid surface 108 may alternatively comprise any other suitable solid surface in a room containing the television 102. For example, any suitable wall or ceiling may be used as a sound reflector. The use of walls behind the listener may allow him or her to perceive sounds from the rear, as commonly generated by home theater systems. In this case, the listener typically remains in the direct path of the reflected audio sound beam because the sound directivity after reflection generally does not change. The home theater listening experience may be enhanced by using a number of walls to direct multiple reflected sounds toward the listener.

In the event some of the audio sound beams reaching the listener come from undesired directions (e.g., when some sound beams inadvertently reflect off of the ceiling or a wall), spatial Digital Signal Processing (DSP) filtering may be employed to eliminate the unwanted sound. Spatial DSP filtering may also be employed to create a psycho-acoustical perception of sound originating from directions other than that actually occurring in reality. This typically involves subtle filtering and delaying of audio signals before directing the sound to the listener. It is understood that two or more audio sound beams generated using any of the above-described configurations may be employed for stereo listening.

Figure 3:
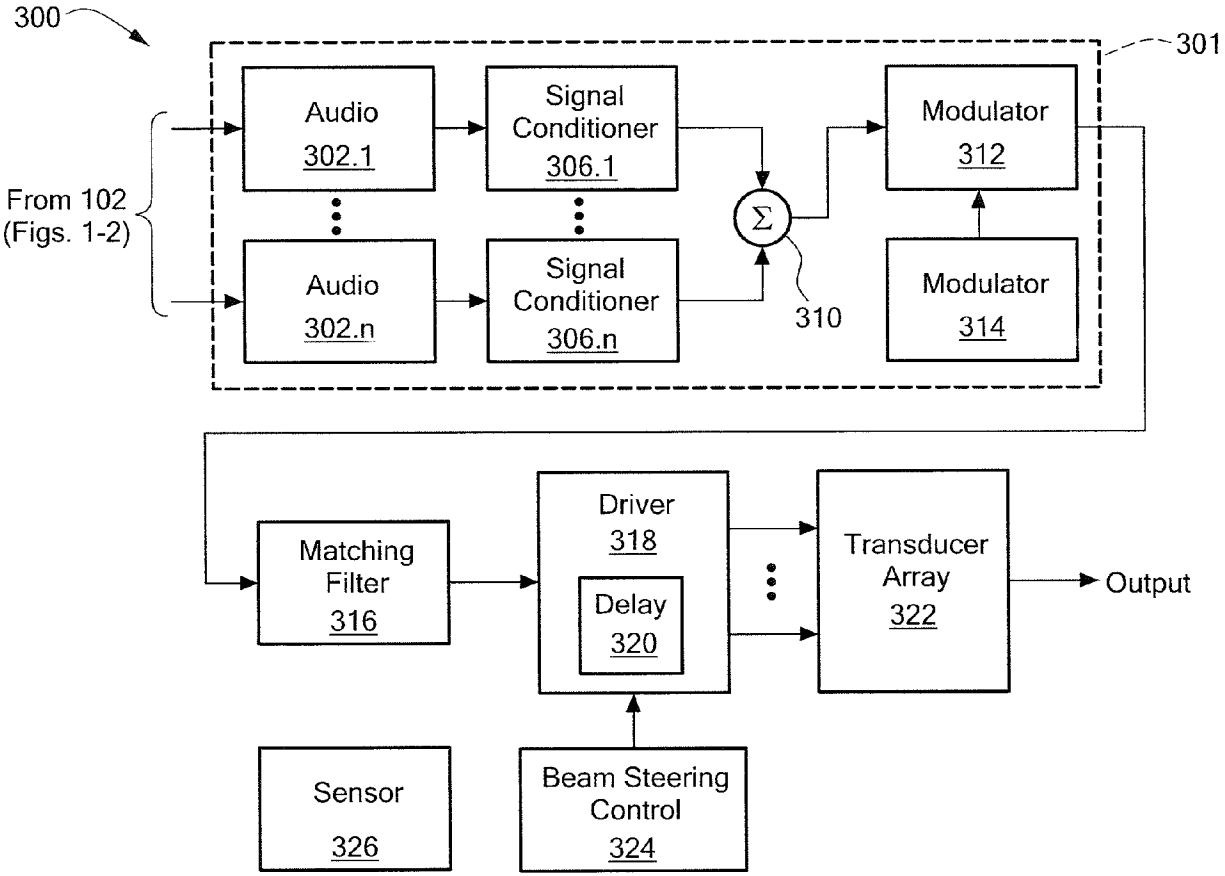
FIG. 3 is a block diagram of the directed acoustic sound system of FIG. 1.

FIG. 3 depicts an illustrative embodiment 300 of the directed acoustic sound system 100 (see FIG. 1). In the illustrated embodiment, the directed acoustic sound system 300 comprises a parametric audio sound system including a signal generator 301, an optional matching filter 316, a driver amplifier 318 coupleable to optional beam steering control circuitry 324, and a parametric array 322, which comprises one or more acoustic transducers. A parametric audio system like that included in the directed acoustic sound system 300 is disclosed in co-pending U.S. patent application Ser. No. 09/758,606 filed Jan. 11, 2001 entitled PARAMETRIC AUDIO SYSTEM, which is incorporated herein by reference.

Specifically, the parametric array 322 includes at least one acoustic transducer configured to be driven by the signal generator 301, which includes a modulator 312 coupled to an ultrasonic carrier signal generator 314, and one or more audio channels 302.1-302.*n*. For example, the television 102 (see FIGS. 1-2) may provide one or more audio signals (e.g., audio Left (L) and audio Right (R); see also FIGS. 6*a*-6*b*) to the audio channels 302.1-302.*n*. Optional signal conditioning circuits 306.1-306.*n* receive respective audio signals provided via the audio channels **302.1-302.*n*, and provide conditioned audio signals to a summer 310. It is noted that such conditioning of the audio signals may alternatively be performed after the audio signals are summed by the summer 310. The modulator 112 receives a composite audio signal from the summer 310 and an ultrasonic carrier signal from the carrier generator 314, and modulates the ultrasonic carrier signal with the composite audio signal. The modulator 312 is preferably adjustable in order to vary the modulation index. Amplitude modulation by multiplication with a carrier is preferred, but because the ultimate goal of such modulation is to convert audio-band signals into ultrasound, any form of modulation providing that result may be used. The modulator 312 provides the modulated carrier signal to the optional matching filter 316, which is configured to compensate for the generally non-flat frequency response of the driver amplifier 318 and the parametric array 322. The matching filter 316 provides the modulated carrier signal to the driver amplifier 318, which in turn provides an amplified version of the modulated carrier signal to the acoustic transducer of the parametric array 322. The driver amplifier 318 may include a delay circuit 320 configured to apply a relative phase shift and/or amplitude shading across multiple frequencies of the modulated carrier signal to steer, focus, or shape the ultrasonic beam generated at the output of the parametric array 322**. The ultrasonic beam, which comprises the high intensity ultrasonic carrier signal amplitude-modulated with the composite audio signal, is demodulated on passage through the propagation medium, e.g., the air, due to the air's non-linear propagation characteristics, thereby generating audible sound.

In the preferred embodiment, the frequency of the carrier signal generated by the ultrasonic carrier signal generator 314 is on the order of 45 kHz or higher. Because the audio signals provided via the audio channels **302.1-302.*n*** typically have a maximum frequency of about 20 kHz, the lowest frequency components of substantial intensity according to the strength of the audio signal in the modulated ultrasonic carrier signal have a frequency of about 25-35 kHz or higher. Such frequencies are typically above the range of human hearing.

Figure 4:
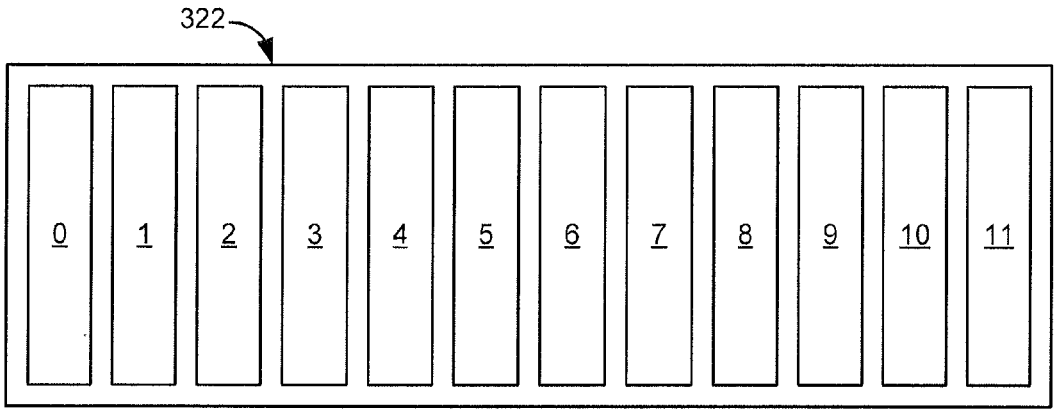
FIG. 4 is a plan view of a parametric loudspeaker included in the directed acoustic sound system of FIG. 3.

FIG. 4 depicts an illustrative embodiment of the parametric array 322 included in the directed acoustic sound system 300 (see FIG. 3). In the illustrated embodiment, the parametric array 322 includes a plurality of acoustic transducers 0-11 arranged in a one-dimensional configuration. It should be understood, however, that the plurality of acoustic transducers may alternatively be arranged in 2-3 dimensional configurations. Each of the acoustic transducers 0-11 has a generally rectangular shape to facilitate close packing in the one-dimensional configuration. It should be understood, however, that other suitable geometrical shapes (e.g., a disk or a cylinder) and other suitable configurations of the acoustic transducers may be employed. For example, the acoustic transducers may be shaped for arrangement in an annular or "ring" configuration.

In the preferred embodiment, each of the acoustic transducers 0-11 comprises a capacitor transducer, more particularly a membrane-type transducer such as a membrane-type PVDF transducer, a membrane-type electret transducer, a membrane-type electrostrictive transducer, or a membrane-type electrostatic transducer (e.g., a Sell-type electrostatic transducer). In an alternative embodiment, the acoustic transducers 0-11 may comprise piezoelectric transducers. It is noted that the bandwidth of the parametric array 322 is preferably on the order of 5 kHz or higher, and more preferably on the order of 10 kHz or higher as enhanced by the matching filter 316. Membrane-type transducers suitable for use in the acoustic sound system 300 are described in co-pending U.S. patent application Ser. No. 09/300,200 filed Apr. 27, 1999 entitled ULTRASONIC TRANSDUCERS, and co-pending U.S. patent application Ser. No. 10/268,004 filed Oct. 9, 2002 entitled ULTRASONIC TRANSDUCER FOR PARAMETRIC ARRAY, which are incorporated herein by reference.

Figure 5:
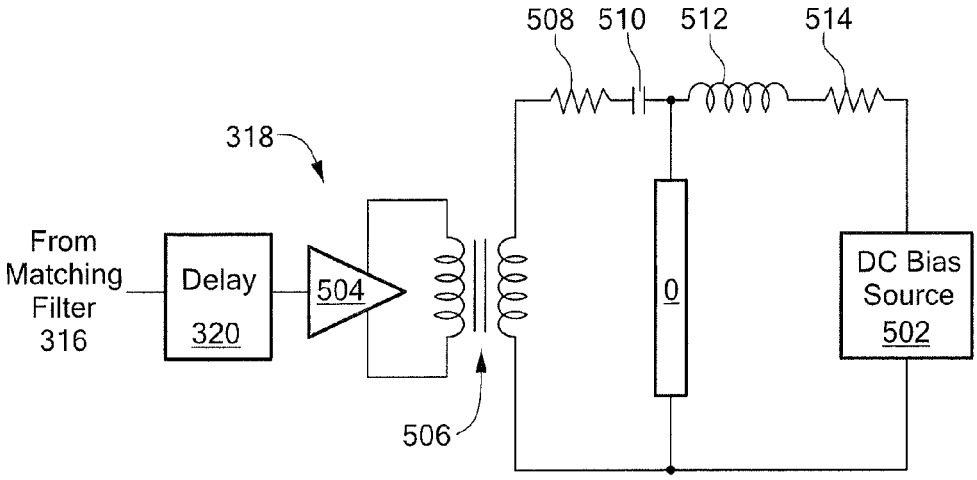
FIG. 5 is a schematic diagram of a driver amplifier circuit included in the directed acoustic sound system of FIG. 3.

FIG. 5 depicts an illustrative embodiment of the driver amplifier 318 included in the directed acoustic sound system 300 (see FIG. 3). In the illustrated embodiment, the driver amplifier 318 includes the delay circuit 320, an amplifier 504, a transformer 506, resistors 508 and 514, a capacitor 510, an inductor 512, the acoustic transducer 0, and a DC bias source 502. It is noted that a respective delay circuit 320 is preferably provided for each of the acoustic transducers 0-11 (see FIG. 4). FIG. 5 shows the driver amplifier 318 driving only the acoustic transducer 0 for clarity of discussion.

As shown in FIG. 5, the delay circuit 320 receives the modulated carrier signal from the matching filter 316 (see FIG. 3), applies a relative phase shift and/or amplitude shading to the modulated carrier signal for steering/focusing/shaping the ultrasonic beam generated by the parametric array 322, and provides the modulated carrier signal to the amplifier 504. The primary winding of the transformer 506 receives the output of the amplifier 504, and the secondary winding of the transformer 506 provides a stepped-up voltage to the series combination of the acoustic transducer 0, the resistor 508, and the blocking capacitor 510. Further, a DC bias is applied to the acoustic transducer 0 from the DC bias source 502 via the isolating inductor 512 and the resistor 514. The capacitor 510 has relatively low impedance and the inductor 512 has relatively high impedance at the operating frequency of the driver amplifier 318. Accordingly, these components typically have minimal effect on the circuit operation except to isolate the AC and DC portions of the circuit. In an alternative embodiment, the inductor 512 may be replaced by a very large resistor value. It is noted that the blocking capacitor 510 may be omitted when the DC bias is provided by an electret.

In a preferred embodiment, the secondary winding of the transformer 506 is configured to resonate with the capacitance of the acoustic transducer 0 at the center frequency of the acoustic transducer 0, e.g., 45 kHz or higher. This effectively steps-up the voltage across the acoustic transducer and provides a highly efficient coupling of the power from the driver amplifier 318 to the acoustic transducer. Without the resonant circuit formed by the secondary winding of the transformer 506 and the acoustic transducer capacitance, the power required to drive the acoustic sound system 300 would be very high, i.e., on the order of hundreds of watts. With the resonant circuit, the power requirement reduction corresponds to the Q-factor of resonance. It is noted that the electrical resonance frequency of the driver amplifier 318, the center frequency of the acoustic transducer 0, and the ultrasonic carrier frequency preferably have the same frequency value.

As described above, the delay circuit 320 (see FIGS. 3 and 5) applies a relative phase shift and/or amplitude shading across multiple frequencies of the modulated carrier signal to steer, focus, or shape ultrasonic beams generated by the parametric array 322. The parametric array 322, more particularly the one-dimensional parametric array 322 of FIG. 4, is therefore well suited for use as a phased array. Such phased arrays may be employed for electronically steering audio beams toward desired locations along selected projection paths, without requiring mechanical motion of the parametric array 322. Further, such phased arrays may be used to vary audio beam characteristics such as the beam width, the beam focus, and the beam spread.

Specifically, the parametric array 322 operates as a phased array by manipulating the phase relationships between the acoustic transducers included therein to obtain a desired interference pattern in the ultrasonic field. For example, the one-dimensional parametric array 322 (see FIG. 4) may manipulate the phase relationships between the acoustic transducers 0-11 via the delay circuit 320 (see FIGS. 3 and 5) so that constructive interference of ultrasonic beams occurs in one desired direction. As a result, the one-dimensional parametric array 322 steers the modulated ultrasonic beam in that direction electronically. Further, the direction of the modulated ultrasonic beam may be changed in real-time via the beam steering control circuitry 324 (see FIG. 3).

Figure 6A:
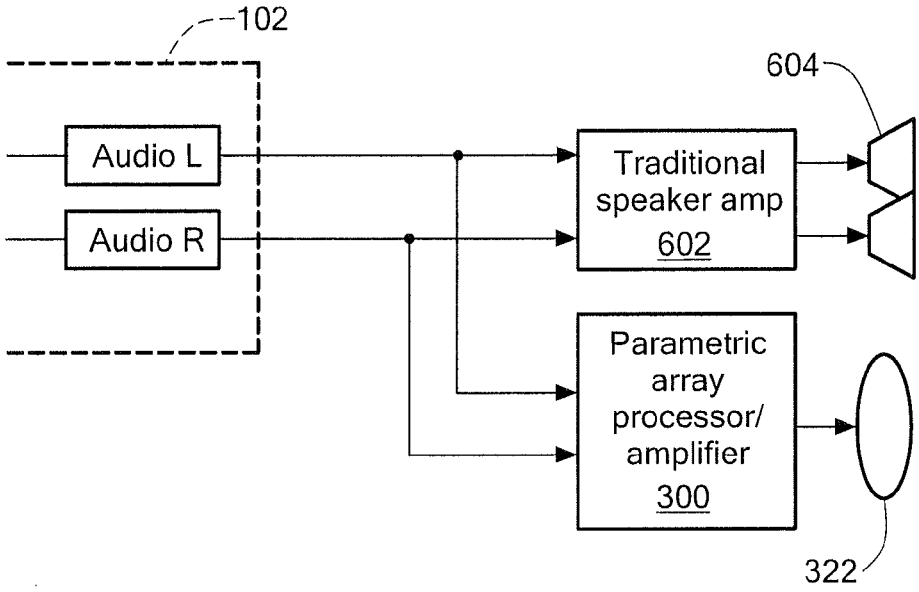
FIGS. 6*a*-6*b* are block diagrams of the directed acoustic sound system of FIG. 3 employed in conjunction with conventional speaker amplifiers.
Figure 6B:
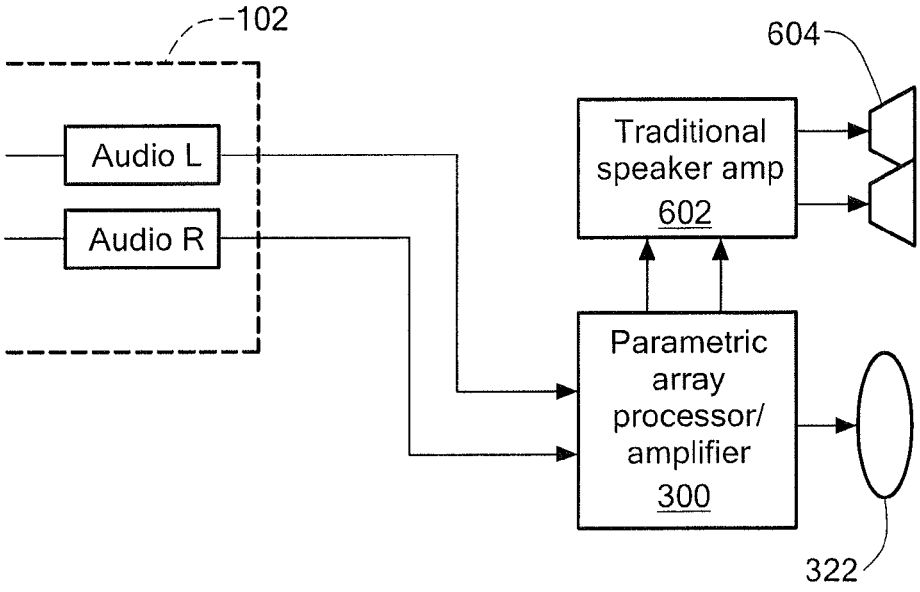

FIGS. 6*a*-6*b* depict the directed acoustic sound system 300 employed in conjunction with conventional speaker amplifiers. In the preferred embodiment, the signal handling capability of the acoustic sound system 300 accommodates the use of conventional loudspeakers 604 and/or the directional acoustic transducer loudspeaker 322, depending on the needs of the listener and the characteristics of the listening environment.

As shown in FIG. 6*a*, the television 102 (see FIGS. 1-2) provides audio L and audio R signals to a conventional speaker amplifier 602 and to the parametric array processor/amplifier of the directed acoustic sound system 300. For example, the speaker amplifier 602 may comprise a class AB audio speaker amplifier, a class D audio speaker amplifier, or any other suitable audio speaker amplifier for driving the conventional loudspeakers 604. In the illustrated embodiment, the speaker amplifier 602 and the acoustic sound system 300 are connected in parallel. It is noted that the acoustic sound system 300 may include a stereo parametric array amplifier, or a mono parametric array amplifier requiring a combination of the audio L and audio R channels. In the configuration of FIG. 6*a*, the conventional speaker system including the loudspeakers 604 may be muted or turned-off when it is desired to hear only the acoustic sound system including the directional loudspeaker 322. Similarly, the acoustic sound system including the directional loudspeaker 322 may be muted or turned-off when it is desired to hear only the conventional speaker system including the loudspeakers 604.

As shown in FIG. 6*b*, the television 102 (see FIGS. 1-2) provides the audio L and audio R signals to the parametric array processor/amplifier of the directed acoustic sound system 300. In the illustrated embodiment, the speaker amplifier 602 and the acoustic sound system 300 are connected in series, i.e., the directed acoustic sound system is connected in-line with the conventional speaker system. In this configuration, the listener may select the conventional speaker system, the directed acoustic sound system, or both systems, by simply making a selection using known mechanical and/or electronic techniques. In the event the listener selects the directional loudspeaker 322 only, the audio L and audio R signals are combined and subsequently recreated by the directed acoustic sound system 300, and the corresponding audio L and R signals normally provided to the conventional speaker amplifier 602 are made to be approximately zero. In the event the listener desires a more traditional listening experience, the audio L and R signals are provided to the speaker amplifier 602 while the signal processing circuitry of the acoustic sound system 300 is placed in an inactive state.

As shown in FIGS. 6*a*-6*b*, the audio L and audio R signals are provided by the television 102 (see FIGS. 1-2). Such televisions typically have at least one line-out connector for audio output signals. It is noted that the listener may be required to mute the internal loudspeaker of the television when using the line-out connection. In alternative embodiments, the audio output signals may be provided by an auxiliary signal source such as a Video Cassette Recorder (VCR), a cable TV box, a DVD player, or any other suitable signal source. The television 102 may also have a headphone jack (not shown), which may be used to capture audio output signals for subsequent reproduction by the directional loudspeaker 322. Moreover, audio signals may be provided by multiple electronic systems, e.g., a television, a CD player, and a speakerphone. In this case, the listener may first select the desired system, and then select the conventional speaker system or the directional speaker system for reproducing the audio signals provided by that system.

Figure 7:
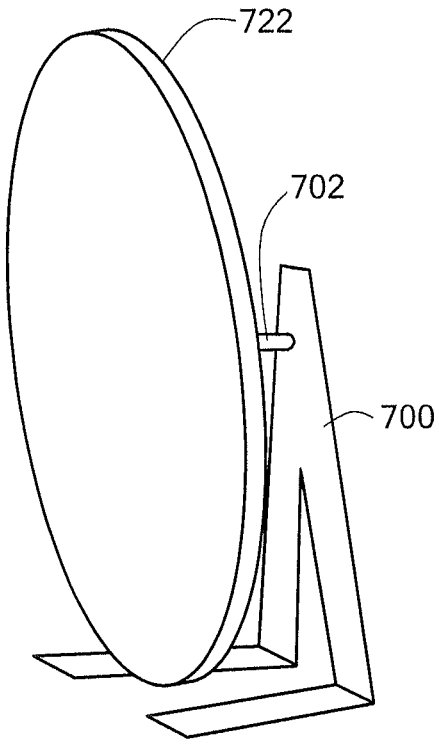
FIG. 7 is a perspective view of a directional loudspeaker included in the directed acoustic sound system of FIG. 1, the loudspeaker being mounted on a stand.

FIG. 7 depicts an illustrative embodiment of a stand 700 for use with a directional acoustic transducer loudspeaker 722 configured as a circular disk. In the illustrated embodiment, the stand 700 may be employed in a freestanding configuration on the television 102 (see FIGS. 1-2) or on the floor beside the television set or the television viewer. In the preferred embodiment, the stand 700 includes a ball joint 702 to facilitate aiming of the circular disk.

Having described the above illustrative embodiment of the directed acoustic sound system, other alternative embodiments or variations may be made. For example, in some circumstances, it may be beneficial to use a subwoofer with the acoustic sound system to supplement the low frequencies. Conventional subwoofers are essentially non-directional, so they may be heard by others in the general vicinity of the sound system. However, if the output of the subwoofer is limited to very low frequencies, this tends not to be an issue because such low frequencies are normally not bothersome to humans. In alternative embodiments, a localized subwoofer may be employed in the form of, e.g., a seat-mounted vibrator, pillow, or pad fashioned to present low frequency vibration directly to the intended listener.

In addition, the parametric array processor may be provided with dynamic compression or equalization functionality to enhance the reproduced audio. For example, a suitable equalization routine may specify a high pass filter frequency corresponding to the desired output level. Because high frequencies generally require less energy to reproduce, more output may be obtained if the low signal frequencies are attenuated. The result would effectively be a high pass filter with frequency controlled via the incoming volume level and/or the listener's volume settings. Further, because many electronic systems have a line-out connection that is not volume controlled, the parametric array processor/amplifier may be provided with an independent volume control. Moreover, the directed acoustic sound system may be provided with a proximity sensor 326 (e.g., ultrasonic, echo, etc.; see FIG. 3) to detect how far the listener is from the system. The parameters of the parametric array processor may then be optimally adjusted based on the detected proximity information.

In addition, the directed acoustic sound system may employ a remote control device for controlling volume, tone, signal switch selections, etc. For example, the remote control device may employ optical, acoustic, infrared (IR), Radio Frequency (RF), or any other suitable means of remote control. It is noted that RF remote control permits reception without requiring a line-of-sight to the system, and therefore this type of remote control is particularly advantageous when the system is hidden from view. Because it would be desirable to allow the listener to use his or her own existing remote control device, the acoustic sound system may be configured to "learn" the proper codes for "volume up", "volume down", etc., from the existing remote control device. The acoustic sound system may also be provided with a memory for retaining the volume setting, the tone setting, the signal switch selections, etc., when system power is turned-off.

For IR remote control devices, there must typically be a line-of-sight access to the remote receiver. In the preferred embodiment, the remote receiver is mounted in or near the parametric array because the transducer is normally in the line-of-sight of the listener. The remote receiver may then provide the remote control signals to the parametric array processor/amplifier. The acoustic transducer disk or its mounting stand may also provide status information such as the volume setting or the source material selection via a display.

In the preferred embodiment, a movable motorized disk-mounting stand is provided to account for varying listener positions. The motorized stand may have one or more preset positions corresponding to respective listening positions. Alternatively, the mounting stand may track the listener automatically by sensing sounds produced by the listener's movements using any suitable sound-sensing mechanism. As described above, a phased array may also be employed to steer the audio sound beams.

In addition, the directed acoustic sound system may include a fan to cool the system. Instead of having the fan turned-on all of the time, the fan may be activated automatically when the temperature exceeds a predetermined level. Hysteresis/delay may also be employed to prevent the occurrence of undue oscillation of the system resulting from multiple fan cycles.

In addition, sound absorbing materials may be disposed in the paths of the reflected audio sound beams to prevent sound from reflecting into undesirable areas. The audio sound beams generated by the directed acoustic sound system may also be used to mask background noises, thereby making an area such as an office environment appear quieter to the listener. The acoustic sound system may also be employed to direct white or filtered white noise toward the listener.

In addition, it was described above that the television 102 (see FIGS. 1-2) provides audio L and audio R signals to the conventional speaker amplifier 602 and to the parametric array processor/amplifier of the directed acoustic sound system 300 (see FIGS. 6*a*-6*b*). In an alternative embodiment, the audio channel, the speaker amplifier 602, and the directed acoustic sound system 300 may comprise portions of a speakerphone (also known as a "hands-free" telephone system). For example, the hands-free telephone system may include a telephone receiver configured to receive information representative of the audio channel. Conventional hands-free telephone systems are frequently sources of annoyance and distraction in open-office space environments because the sound leaving the telephone console is typically non-directional—virtually everyone in the vicinity of the system may hear the telephone conversation. By applying a directional speaker to the telephone interface, sound from the telephone can be directed toward the intended listener(s) only. As a result, the sound from the phone will not be substantially heard by others nearby.

In effect, the audio sound beams generated by the directional speaker of the hands-free telephone system "shine" upon the intended listener(s) from convenient locations in a way that is analogous to a private lighting system in a darkened room. Music-playing functionality may also be added to the hands-free telephone system to allow the user to listen to music at his or her desk without distracting coworkers nearby, and without requiring the use of headphones. Such music-playing capability may be added to the system via an audio jack connected to a host personal computer. It is further noted that the directional speaker may be mounted from a fixture attached to a cubicle by a "swing-arm" assembly like those typically used with desk lamps. This allows the audio sound beams to be aimed directly at the intended listener. Moreover, because it requires virtually no user adjustments, the acoustic sound system may be placed in any convenient location. Audio output signals from the hands-free telephone system (and/or the personal computer) may be provided to the conveniently located acoustic sound system to power the directional speaker.

It will also be appreciated by those of ordinary skill in the art that further modifications to and variations of the above-described directed acoustic sound system may be made without departing from the inventive concepts disclosed herein. Accordingly, the invention should not be viewed as limited except as by the scope and spirit of the appended claims.

What is claimed is:

1. A method of providing directed acoustic sound in an electronic entertainment system having a non-directional audio speaker system, comprising the steps of:

providing, by the electronic entertainment system, one or more audio signals to a directed acoustic sound system, the directed acoustic sound system being connected in-line with the non-directional audio speaker system so as to provide the one or more audio signals to the non-directional audio speaker system, the directed acoustic sound system and the non-directional audio speaker system being selectable by a user of the electronic entertainment system;

in response to a first user selection of the directed acoustic sound system:

suppressing, by the directed acoustic sound system, the one or more audio signals at the non-directional audio speaker system;

generating a sound beam from the one or more audio signals by the directed acoustic sound system; and projecting, by the directed acoustic sound system, the sound beam through the air along a pre-selected path to reproduce the one or more audio signals along at least a portion of the pre-selected path, thereby providing the user disposed substantially in the portion of the pre-selected path wire with a private listening experience; and in response to a second user selection of the non-directional audio speaker system:

reproducing the one or more audio signals by the non-directional audio speaker system.

2. The method of claim 1 further including, in response to the first user selection of the directed acoustic sound system, combining the one or more audio signals by the directed acoustic sound system, wherein the generating of the sound beam includes generating the sound beam from the combined audio signals by the directed acoustic sound system.

3. The method of claim 1 further including, in response to the second user selection of the non-directional audio speaker system, placing the directed acoustic sound system in an inactive state.

4. The method of claim 1 further including, in response to a third user selection of both the directed acoustic sound system and the non-directional audio speaker system, projecting, by the directed acoustic sound system, the sound beam through the air along the pre-selected path to reproduce the one or more audio signals along at least a portion of the pre-selected path, while reproducing the one or more audio signals by the non-directional audio speaker system.

5. The method of claim 1 wherein the one or more audio signals correspond to one or more audio channels, respectively, wherein the directed acoustic sound system includes a plurality of directional loudspeakers, and further including providing a respective one of the one or more audio channels for each directional loudspeaker.

6. The method of claim 1 wherein the directed acoustic sound system includes a directional loudspeaker, and further including detecting, by at least one sensor, a distance from the directional loudspeaker to the user, or a position of the user relative to the directed acoustic sound system.

7. The method of claim 6 wherein the generating of the sound beam includes generating the sound beam with characteristics based at least in part on the detected distance from the directional loudspeaker to the user, or the position of the user relative to the directed acoustic sound system.

8. The method of claim 1 wherein the directed acoustic sound system includes a modulated signal generator, and wherein the method further includes generating an ultrasonic carrier signal modulated with at least one of the one or more audio signals by the modulated signal generator.

9. The method of claim 8 wherein the directed acoustic sound system further includes a delay circuit, and wherein the method further includes applying a relative phase shift across a plurality of frequencies of the modulated ultrasonic carrier signal by the delay circuit, thereby steering, focusing, or shaping the sound beam projected by the directional loudspeaker.

10. The method of claim 1 further including amplifying the one or more audio signals prior to providing the one or more audio signals to the directed acoustic sound system.

11. The method of claim 1 wherein the one or more audio signals include low frequency components, and wherein the method further includes, at least in response to the first user selection of the directed acoustic sound system, reproducing the low frequency components of the one or more audio signals by a subwoofer.

12. The method of claim 1 wherein the non-directional audio speaker system includes a non-directional subwoofer, wherein the one or more audio signals include low frequency components, and wherein the method further includes, at least in response to the first user selection of the directed acoustic sound system, reproducing the low frequency components of the one or more audio signals by the non-directional subwoofer.

13. A method of providing directed acoustic sound in an electronic entertainment system having a non-directional audio speaker system, comprising the steps of:

providing, by the electronic entertainment system, one or more audio signals to a directed acoustic sound system and the non-directional audio speaker system, the directed acoustic sound system and the non-directional audio speaker system being selectable by a user of the electronic entertainment system;

in response to a first user selection of the directed acoustic sound system:

suppressing the one or more audio signals at the non-directional audio speaker system;

generating a sound beam from the one or more audio signals by the directed acoustic sound system; and projecting, by the directed acoustic sound system, the sound beam through the air along a pre-selected path to reproduce the one or more audio signals along at least a portion of the pre-selected path, thereby providing the user disposed substantially in the portion of the pre-selected path with a private listening experience; and in response to a second user selection of the non-directional audio speaker system:

reproducing the one or more audio signals by the non-directional audio speaker system.

14. The method of claim 13 further including, in response to the first user selection of the directed acoustic sound system, combining the one or more audio signals by the directed acoustic sound system, wherein the generating of the sound beam includes generating the sound beam from the combined audio signals by the directed acoustic sound system.

15. The method of claim 13 further including, in response to the second user selection of the non-directional audio speaker system, placing the directed acoustic sound system in an inactive state.

16. The method of claim 13 further including, in response to a third user selection of both the directed acoustic sound system and the non-directional audio speaker system, projecting, by the directed acoustic sound system, the sound beam through the air along the pre-selected path to reproduce the one or more audio signals along at least a portion of the pre-selected path, while reproducing the one or more audio signals by the non-directional audio speaker system.

17. The method of claim 13 wherein the one or more audio signals correspond to one or more audio channels, respectively, wherein the directed acoustic sound system includes a plurality of directional loudspeakers, and further including providing a respective one of the one or more audio channels for each directional loudspeaker.

18. The method of claim 13 wherein the directed acoustic sound system includes a directional loudspeaker, and further including detecting, by at least one sensor, a distance from the directional loudspeaker to the user, or a position of the user relative to the directed acoustic sound system.

19. The method of claim 18 wherein the generating of the sound beam includes generating the sound beam with characteristics based at least in part on the detected distance from the directional loudspeaker to the user, or the position of the user relative to the directed acoustic sound system.

20. The method of claim 13 wherein the directed acoustic sound system includes a modulated signal generator, and wherein the method further includes generating an ultrasonic carrier signal modulated with at least one of the one or more audio signals by the modulated signal generator.

21. The method of claim 20 wherein the directed acoustic sound system further includes a delay circuit, and wherein the method further includes applying a relative phase shift across a plurality of frequencies of the modulated ultrasonic carrier signal by a delay circuit, thereby steering, focusing, or shaping the sound beam projected by the directional loudspeaker.

22. The method of claim 13 further including amplifying the one or more audio signals prior to providing the one or more audio signals to the directed acoustic sound system.

23. The method of claim 13 wherein the one or more audio signals include low frequency components, and wherein the method further includes, at least in response to the first user selection of the directed acoustic sound system, reproducing the low frequency components of the one or more audio signals by a subwoofer.

24. The method of claim 13 wherein the non-directional audio speaker system includes a non-directional subwoofer, wherein the one or more audio signals include low frequency components, and wherein the method further includes, at least in response to the first user selection of the directed acoustic sound system, reproducing the low frequency components of the one or more audio signals by the non-directional subwoofer.

* * * * *